US005710555A

United States Patent [19]

McConnell et al.

[11] Patent Number: 5,710,555

[45] Date of Patent: Jan. 20, 1998

[54] SIREN DETECTOR

[75] Inventors: Peter Robert Henderson McConnell; Patricia Fern Kavanagh, both of Burnaby, Canada

[73] Assignee: Sonic Systems Corporation, Vancouver, Canada

[21] Appl. No.: 649,179

[22] Filed: May 17, 1996

Related U.S. Application Data

[63] Continuation of Ser. No. 204,839, Mar. 1, 1994.

[51] Int. Cl.[6] ..... G08G 1/07

[52] U.S. Cl. ..... 340/916; 340/943; 340/902; 340/933; 340/904; 340/906; 340/917

[58] Field of Search ..... 340/902, 916, 340/906, 933, 944, 904, 943, 917, 942, 935

[56] References Cited

U.S. PATENT DOCUMENTS

| | | | |
|---|---|---|---|
| 4,238,778 | 12/1980 | Ohsumi | 340/902 |
| 4,587,522 | 5/1986 | Warren | 340/902 |
| 4,864,297 | 9/1989 | Shaw et al. | 340/902 |
| 4,952,931 | 8/1990 | Serageldin et al. | 340/902 |

OTHER PUBLICATIONS

Feher, "Advanced Digital Communications Systems and Signal Processing Techniques", *Prentice-Hall*, Inc., 509–512 (1987).

LaLau, "The ARRL Handbook for Radio Amateurs", *The American Radio Relay League*, 72nd Ed., pp. 15.9–15.13 and 16.1–16.8 (1994).

Orr, "Radio Handbook", 22nd Ed., Chapter 13, pp. 13.1–13.21 (1981).

Roddy, "Electronic Communications", 2nd Ed., Chapter 10, pp. 301–343 (1981).

*Primary Examiner*—Jeffery Hofsass

*Assistant Examiner*—Daryl C. Pope

*Attorney, Agent, or Firm*—Burns, Doane, Swecker & Mathis

[57] ABSTRACT

A improved siren detector for detecting siren sounds which precess at known warble rates, such as yelp, wail, and high-low, within a selected frequency band. A transducer detects the siren sounds and produces a corresponding electrical output signal. This electrical output signal is filtered to reject signals outside of the selected siren frequency band. The signal is processed to determine the amplitude of the electrical signal, and hence the sound level of the siren sound at the transducer input. This signal is also processed by an amplitude limiter and frequency discriminator to determine the instantaneous frequency of the siren sound. This discriminator is followed by a non-linear filter to remove the FM clicks characteristic of siren sounds having a low signal to noise ratio. Selection filters are used to analyze the precession rates, maximum frequency, minimum frequency, and shape of the precession characteristic to classify the siren as to its type, such as yelp, wail, and high-low. A sound which meets the selection criteria and has a sound level above a predetermined threshold causes the siren detector to trigger signal which drives a preempt output. This preempt output signal is input to a traffic light control system. This alerts the traffic light control system to control the Pedestrian Walk/Don't Walk and traffic lights to cause pedestrians to clear the intersection and to provide a preemptive traffic control signal to a vehicle equipped with the appropriate siren.

21 Claims, 17 Drawing Sheets

SIREN DETECTOR

This application is a continuation of application Ser. No. 08/204,839, filed Mar. 1, 1994.

FIELD OF INVENTION

This application pertains to an improved siren detector for detecting siren sounds which precess with known characteristics within a selected frequency band. By detecting siren sounds emitted by an emergency vehicle, the siren detector facilitates preemptive control of traffic lights to enable a vehicle equipped with the appropriate siren to pass through an appropriately equipped intersection on a priority basis.

BACKGROUND OF INVENTION

The prior art has evolved various ways of controlling or "pre-empting" vehicle traffic lights to stop traffic at an intersection so that an emergency vehicle may pass unimpeded through the intersection on a priority basis. One technique involves the placement of a special transmitter on each emergency, vehicle which is to allowed priority passage through intersections. The traffic light controllers at each preemptable intersection are equipped with a receiver which receives signals transmitted by the transmitter and there upon actuates the traffic lights to stop the normal flow of traffic. However this technique is relatively expensive and is cumbersome in that the personnel in the emergency vehicle must manually actuate the transmitter in order to control the traffic light.

Traffic light controllers at preemptable intersection have also been equipped with detectors capable of detecting flashing lights (normally special strobe lights) mounted on each emergency vehicle which is to be allowed priority passage through the preemptable intersections. In essence, this is similar to the system mentioned in the preceding paragraph, in that the emergency vehicle light replaces the special transmitter. The system does however enjoy something of a cost and utility advantage over the system mentioned in the previous paragraph, since emergency vehicles are normally equipped with flashing lights which are actuated in emergency situation. However, the cost advantage diminishes if if special lights must be provided in order to actuate the detector circuitry which interfaces with the traffic signal controller. Moreover, the inventors believe that such system are susceptible to false alarm triggering because, so far as the inventors are aware, there are no regulations regarding the use of flashing lights on non-emergency vehicles. Accordingly, private vehicles may disrupt such systems by equipping their vehicles with flashing lights for the express purpose of actuating the detectors which interface with the traffic light controllers. Perhaps a more serious situation is one in which flashing lights used in advertising signs, commercial window displays, and decorative lighting may falsely trigger the detector. This is most prominent in dense urban areas, which is precisely the area that the preemptive traffic light signalling system is meant to provide reliable triggering and afford the emergency vehicle the shortest possible response time to its destination.

In the inventors view a better solution is to devise circuitry capable of detecting the sounds produced by emergency emergency vehicle sirens. There is clear cost advantage to this approach, in that emergency vehicles are conventionally equipped with sirens (ie. the emergency vehicles do not need to be equipped with additional special purpose equipment ) and a utility advantage in that such such sirens are normally activated in emergency situations (i.e. no separate manual actuation of additional special purpose equipment is required). A further advantage is that regulations do exist which prohibit the use of sirens on non-emergency vehicles.

The prior art has evolved a number of circuits for detecting siren sounds. However, the inventors consider these to be problematic in that they am susceptible to false alarm triggering by sounds emanating from sources other than emergency vehicle sirens. They also provide unreliable detection of siren signals that have a relatively long period as well as very long detection times. The present invention provides an improved siren detector for reliably detecting siren sounds within a selected frequency band and having superior immunity to false alarm triggering by sounds emanating from sounds other than emergency vehicle sirens, and having superior ability to detect siren sounds in the presence of high ambient noise levels, and detecting siren signals which have a relatively long period in a short period of time.

The invention is based on the observation that the majority of siren sounds are characteristic of a frequency modulated (or FM) waveform in which the frequency, is modulated with a very characteristic and periodic waveform. By using techniques common to radio receiver engineering, it is possible to used traditional FM detection schemes to obtain a very accurate estimate of the frequency modulation waveform. This allows simple pattern recognition to be applied to this modulation waveform and accurate recognition of various waveform patterns to be made. In addition, the ability of the FM detection scheme yields a great increase in the ability of this invention to detect sirens in very high noise levels. With the low cost, high degree of functional integration, and ease of reprogramming for different algorithms and parameters, Digital Signal Processing (DSP) techniques lend themselves to the such a siren detection system.

SUMMARY OF INVENTION

The invention provides a siren detector for detecting siren sounds which change the instantaneous frequency of the waveform at known rates within a selected frequency band and with a known period. The siren detector comprises a transducer means for detecting the the siren sound waveforms and producing an electrical output signal representative thereof: an amplifier means for increasing the electrical signal to a suitable level for processing by subsequent processing; first filter means to provide anti-alias filtering prior to the analog to digital conversion process and rejection of other unwanted spectral components; analog to digital converter means for converting the analog electrical signal into a digital representation or discrete time digital signal; a second filter means consisting of a bandpass digital filter to confine the spectrum of the discrete time signal to the bandwidth of the desired siren waveforms to be detected; a Limiter-Discriminator means to measure the instantaneous frequency of the siren waveform; a decimator to reduce the sampling rate of the signal to a lower one than that of the analog to digital converter; a third filter means for removing the "Frequency Modulation (FM) clicks" which are inherent in Frequency Modulated waveforms operating in low signal to noise conditions; a Yelp detector means for detecting the frequency waveform pattern of a Yelp siren; a High-Low detector means for detecting the frequency waveform pattern of a High-Low siren; a Wail detector means for detecting the frequency waveform pattern of a yelp siren; a detector means for detecting the frequency waveform pattern of a siren other desired siren waveform(s); a sound level detection means for determining a signal which is a function of the sound level in the passband of the siren sound incident on the Input Transducer: a squelch detector means for determining the signal to noise ratio of the signal processed within the passband of the siren sound incident on the Input Transducer; and preempt detection logic to determine when a siren sound meets the predetermined criteria to enable the PREMPT signal.

A sound level detector means may be provided for adjusting the sensitivity of the siren detector to reject siren sounds below a selected threshold intensity level. PREEMPT control means are provided for activating the siren detector as the siren sound increases in intensity and exceeds the selected threshold intensity level and for deactivating the siren detector as those sounds reduce in intensity below the selected threshold intensity level.

PREMPT control means may be provided to be applied to a conventional traffic light controller in order to switch the pedestrian control lights to a "don't walk" indication (i.e. the intersection is closed to pedestrian traffic at a relatively early stage, upon detection of the distant siren sounds ). A traffic light control means may be provided in response to the detection of a siren sound and similarly applied to a conventional traffic light controller to switch all of the traffic lights at the intersection to a safe state for the vehicle equipped with the siren as the vehicle nears the intersection. This state may be for all lights to indicate a stop condition, provide a preemptive go signal to all traffic approaching the intersection from the direction of the siren, or other conditions which allow safe passage of the vehicle through the intersection.

DETAILED DESCRIPTION OF THE PREFERRED EMBODIMENT

Emergency vehicle sirens commonly emit sounds which precess between two frequencies, the minimum and maximum frequencies, with known repetition rates and characteristics. Three of the more common siren sound are commonly referred to as the yelp, high-low, and wail. The ideal characteristics are shown in FIGS. 3*a*, 3*b*, and 3*c* respectively. Ideally, the siren has a constant intensity as the signal precesses according to these siren characteristics, and others. A yelp siren sound typically has a minimum frequency of 400 Hz a maximum frequency of 1400 Hz, and a repetition rate of about 3 Hz. A high-low siren sound typically has a minimum frequency of 400 Hz, a maximum frequency of 600 Hz, and a repetition rate of about 1 Hz. A Wail siren sound typically has a minimum frequency of 400 Hz, a maximum frequency of 1400 Hz, and a repetition rate of about 0.25 Hz. Other siren sounds exist, and new ones may be defined, which may also be detected by this invention using the method described in this invention.

Figure 1:
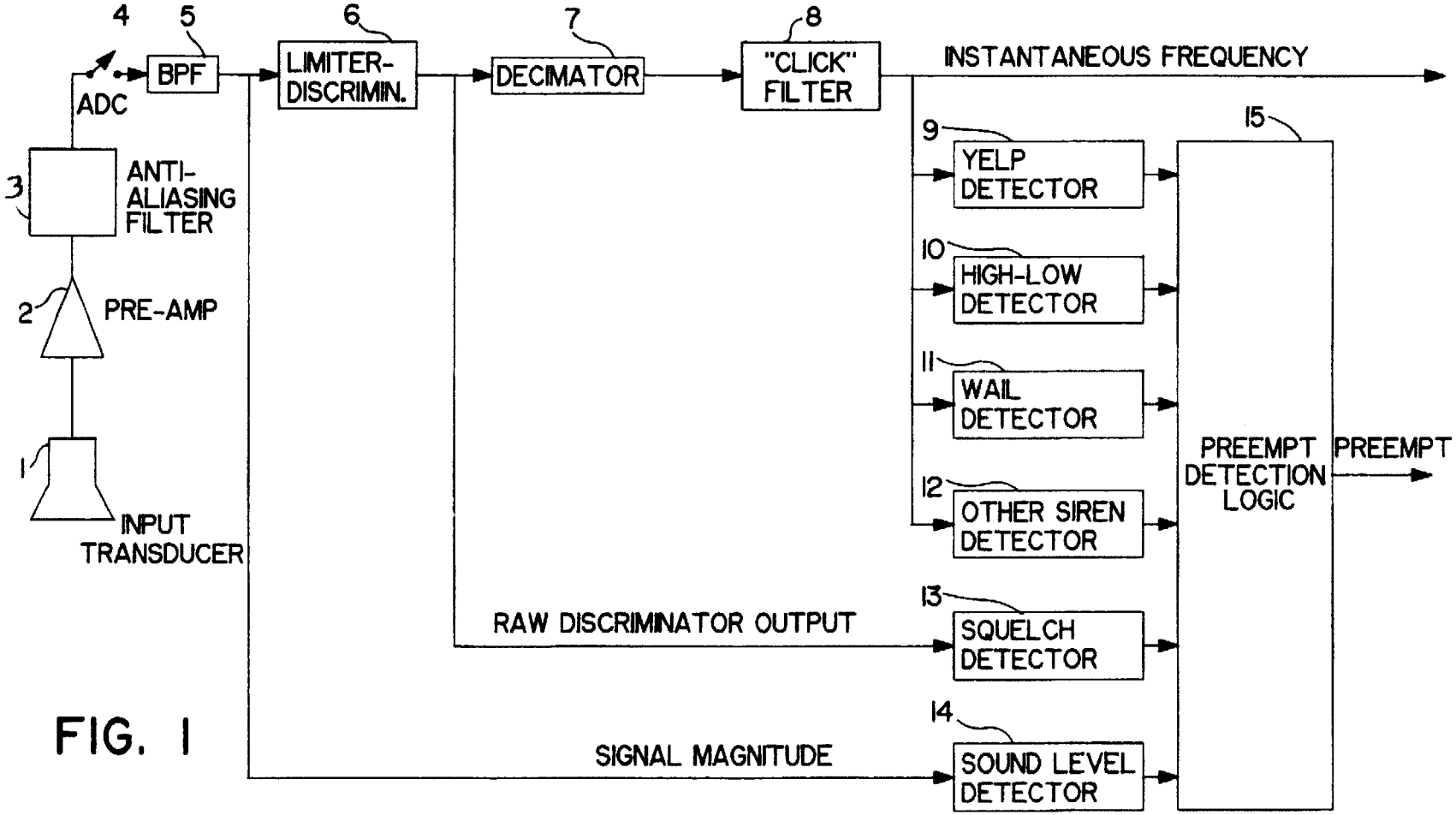
FIG. 1 is a block diagram illustrating the basic operation of the siren detector according to the invention.

FIG. 1 is a block diagram which illustrates the basic operation of a siren detector constructed in accordance with the invention. A brief overview of the invention will first be provided with reference to FIG. 1. A detailed description of the preferred embodiment will then be provided.

Figure 5:
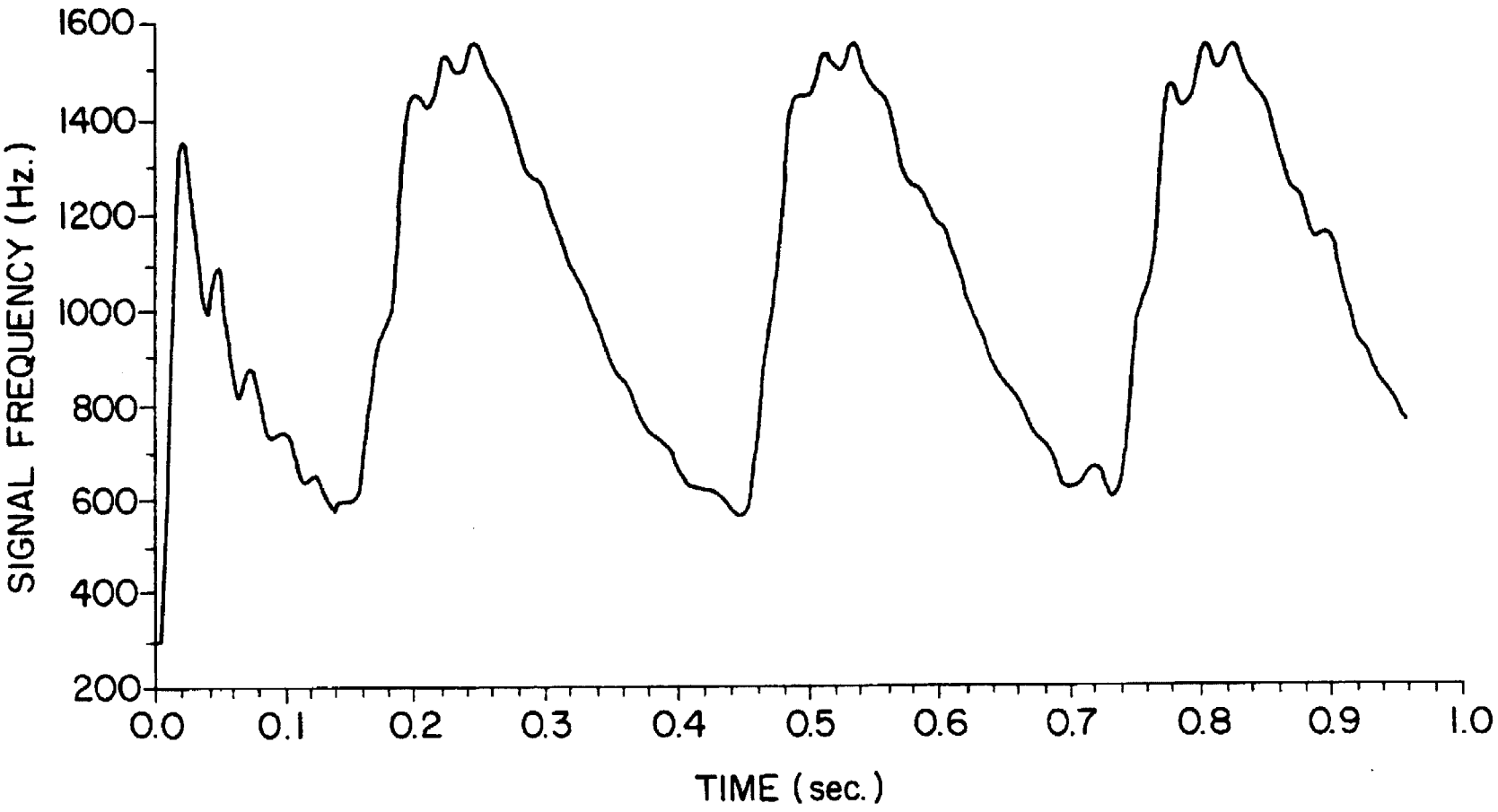
FIGS. 5, 6, and 7 are diagrams illustrating the typical actual characteristics of three of the many common types of siren sound which are detected when processed in accordance with the preferred embodiment of the invention. These are the yelp, high-low, and wall respectively
Figure 6:
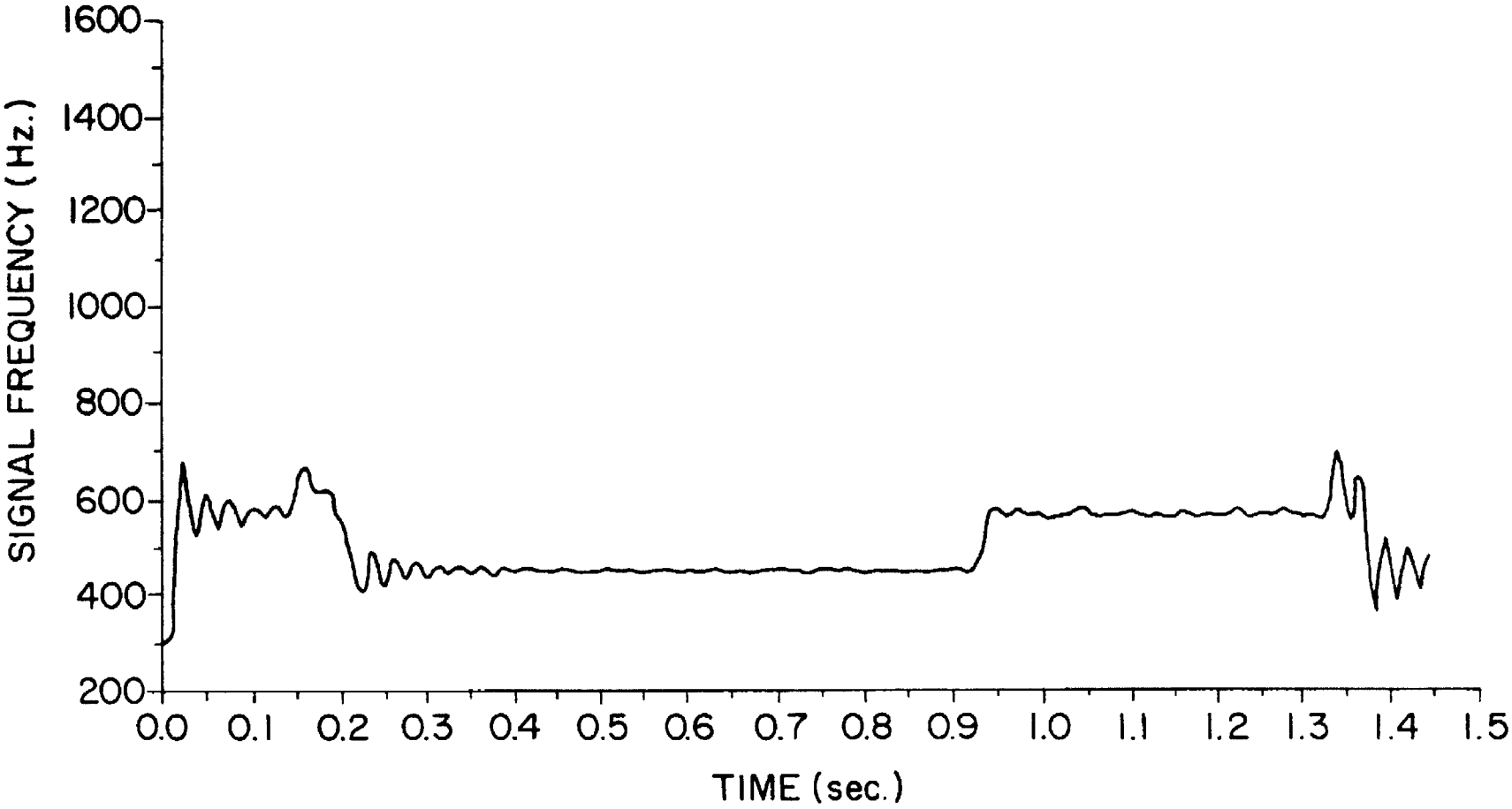
Figure 7:
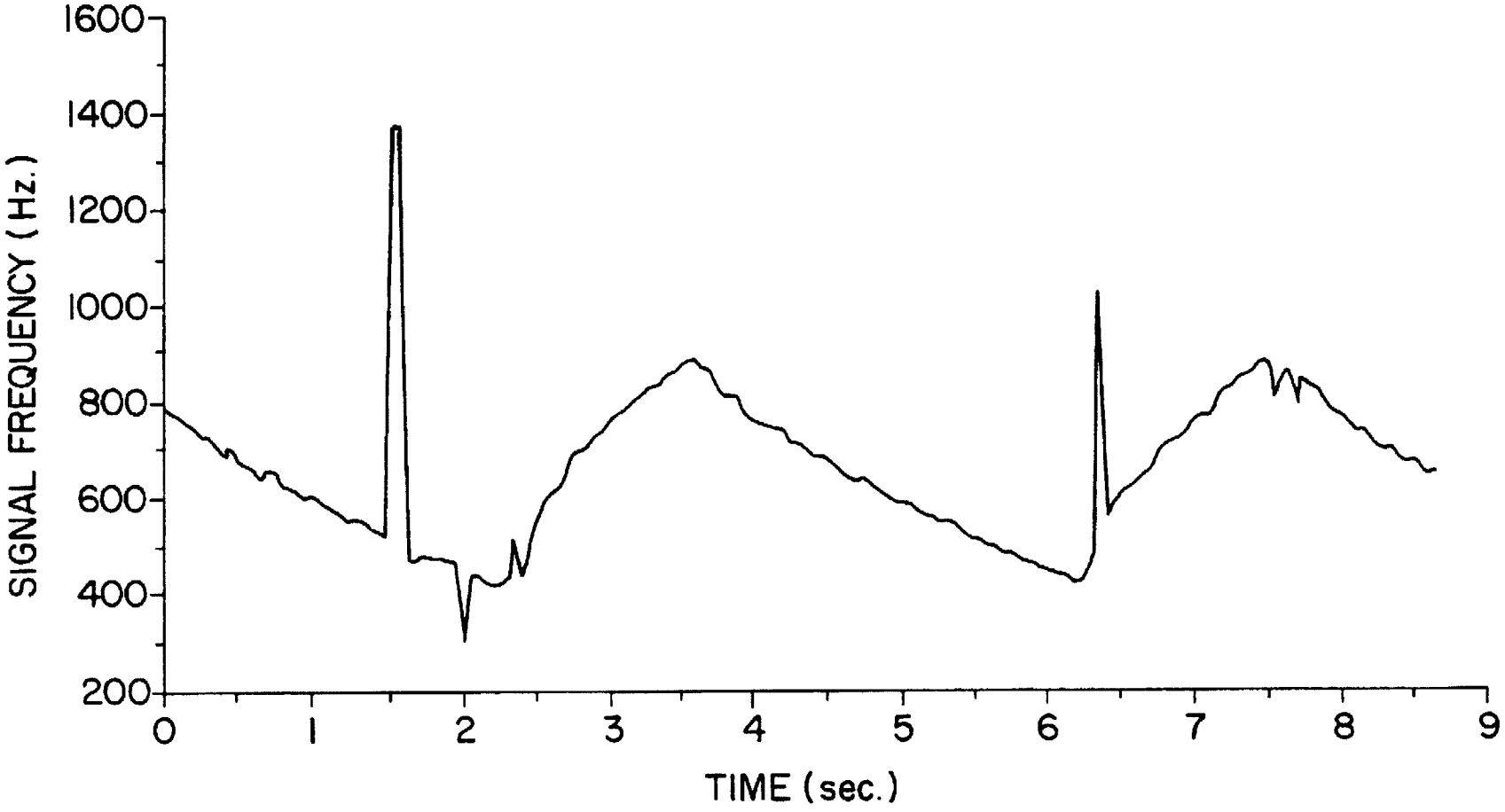

With reference to FIG. 1, the siren detector utilizes an input transducer 1 to detect sound energy and convert those to electrical signals suitable for processing by the siren detector. These electrical signals are amplified to some nominal level for processing. The preamplifier 2 is followed by an anti-aliasing filter 3 prior to the analog to digital converter 4 which converts these analog electrical signals to a digital form for subsequent processing. An analog to digital convertor with a resolution of 12 to 16 bits and a sampling rate of 8.0 kHz has been found to be suitable for processing the wail, yelp, and high-low sirens described so far. A baud pass filter 5 with a passband from about 300 Hz to 1800 Hz has been found to suitable for wail, yelp, and high-low sirens. The sampling rate would have to be increased above 8.0 kHz if sirens with maximum frequencies much higher than those discussed so far are to be sampled without aliasing. The digital bandpass filter 5 is used to remove spectral energy outside of the band found in the wail, yelp, and high-low detectors. A passband of 300 Hz to 1800 Hz has been found to suitable for these sirens. Those skilled in the art will realize that the bandpass Falter 5 can be combined with the phase splitter required for the limiter-discriminator 6 described in FIG. 3, thus reducing the overall complexity of these two functions. The limiter-discriminator 6 measures the instantaneous frequency of the received signal and the magnitude of that signal. Because the spectral components of the frequency output of the limiter-discriminator, representing the precession of the siren signal: are so low for wail, yelp, and high-low sirens, the output sample rate of the limiter-discriminator vastly exceeds that required. For this reason, the limiter-discriminator output signal sampling rate is reduced by the decimator 7 to a much lower sample rate. A decimation of 8.0 kHz to 40 Hz has been found to be suitable. Since the actual spectral content of the sirens variation of frequency with time as shown in FIGS. 5, 6, and 7, is typically less than about 15 Hz, the sample rate after the low pass falter in the decimator need only really be greater than about 30Hz. This sample rate reduction greatly reduces the processing demands of the subsequent steps.

Another key advantage of this low pass falter operation is that it allows the limiter-discriminator detector to operated essentially as a wideband frequency modulation detector. This allows the great improvement in siren detectability over conventional means. As is the case with conventional FM receivers of the type discussed by Jakes, it can be shown as the ratio of the input signal bandwidth at the input transducer 1 to the baseband output of the limiter discriminator 6 increases, the baseband output signal to noise ratio increases for the same input signal to noise ratio. The input bandwidth of the detector is defined by the input signal bandpass falter, which is about 1500 Hertz, and the low pass filter following the limiter-discriminator, which is about 15 Hertz. The performance gains of wideband versus narrowband FM detection is discussed in great deal in the cited reference by Jakes. It is this detection scheme which allows sirens to be detected reliably in condition with signal to noise ratios as low as −2 dB, whereas conventional detection means typically require a signal to noise ratio of about 6 dB or higher. This invention provides approximately 8 dB gain over conventional means.

Figure 8:
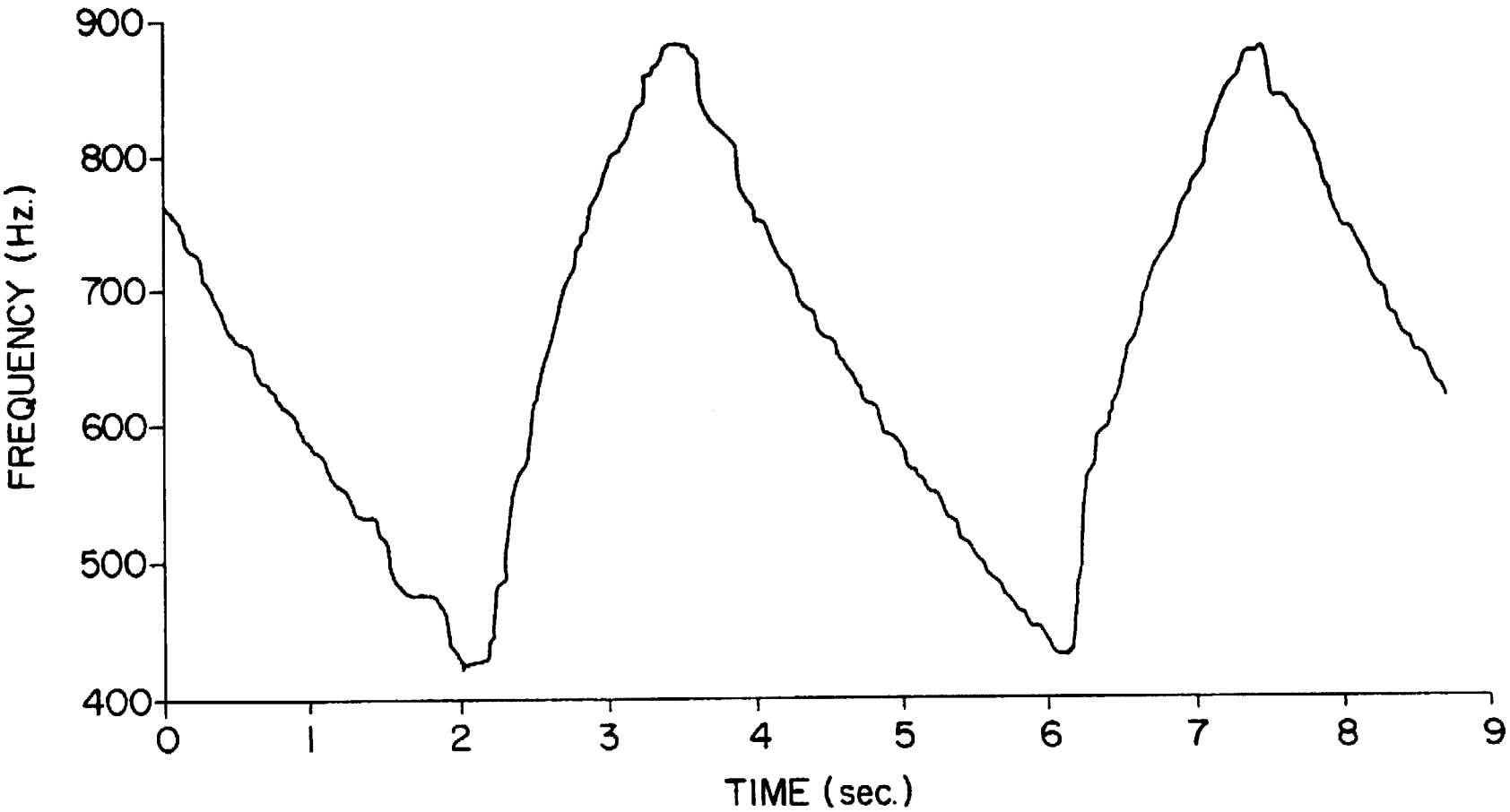
FIG. 8 is a diagram illustrating the effect of the click filter in removing the FM clicks from the received signal when processed in accordance with the preferred embodiment of the invention.

It is a characteristic of discriminator type detectors that an FM modulated waveform, such as the siren sounds, produce impulse noise or "clicks" when the signal to noise ratio of the sound is low. This occurs when a siren sound is some considerable distance from the input transducer, or the background sound level in the vicinity of the input transducer is very high. In any case, these "clicks" create a problem when trying to classify siren sounds belong to one class of a number of classes of sirens. In FIG. 7, the actual limiter-discriminator frequency output signal for a wall siren with a low signal to noise ratio is shown. The clicks are clearly evident at about 1.5 seconds and 6.3 seconds elapsed time in the figure. A click filter 8 as shown in FIG. 1 can very effectively remove these clicks from the limiter-discriminator frequency output signal. The same input signal in FIG. 7 when processed by this click filter results in a median filter output as shown in FIG. 8, where the clicks are seen to be removed. It has been found that a "Median Filter" with a length of 9 samples or about 0.225 seconds time duration is quite effective at removing these clicks. Longer duration Median filters could be user but they show no substantial improvement in performance.

The output of the click filter 8 in FIG. 1 serves as an input to a plurality of detectors. In this case, they are yelp detector 9, High-Low detector 10, and wail detector 11. One of more "Other Siren Detectors" 12 may be added to detect additional siren types, or replace any or all of the yelp, high-low, and wail siren detectors. These detectors determine if the variation of the signal frequency with time meets a number of criteria which classify it as one of a number of siren types which the siren detector has been configured to detect. The output(s) of these detectors serve as one of a number of inputs to the Preempt Detection Logic 15. The preempt detection logic uses the outputs from the siren detectors 9, 10, 11, 12, the squelch detector 13, and the sound level detector 14 to determine if the sound detected meets the siren detection criteria. If they do meet the selection criteria, then the PREEMPT signal to the traffic light controller is enabled.

The output of the Bandpass Filter 5 in FIG. 1, typically with a passband from about 300 Hz to about 1500 Hz., is a signal whose amplitude is a function of the siren loudness or level at the input transducer 1. Since sirens maintain an approximately constant output level and the sound level at 1 increases with decreasing distance between the siren and the input transducer, the signal level at 5 is a function of the distance between the input transducer and the siren. The signal at 5 is input to the Sound Level Detector 14 which measures the magnitude of the that signal and compares it against a preset level threshold. If the magnitude of the sisal at 5 exceeds the level threshold, it enables the output of the Sound Level Detector. If the magnitude of the signal at 5 does not exceeds the level threshold, it disables the output of the Sound Level Detector. The output of the sound level detector serves as one of the inputs to the Preempt Detection Logic 15.

In some situations the ambient sound level from sources other than sirens, such as that due to traffic noise from tires, engine noise, industrial noise, aircraft engine noise, etc., may be so loud that these levels exceed the detection level threshold of the Sound Level Detector 14. In this situation, the output of the sound Level Detector 14 would always be enabled and the siren would cause the Preempt Detection Logic 15 to came a PREEMPT signal sooner than is desired. By utilizing a conventional squelch detector, an additional signal which is a function of the signal to noise ratio is available. The squelch detector is configured such that a threshold signal to noise ratio must be exceeded before the squelch detector output is enabled to indicate this detection criteria has been met.

The PREEMPT detection logic 15 uses combinations of the squelch detector 13 output in addition to the siren detector functions, shown in 9, 10, 11, and 12 and the sound level detector 14 of FIG. 1. In normal urban and suburban situations, the PREEMPT detection logic 15 would only enable the PREEMPT output to the traffic light controller when; (a) the sound reaching then input transducer 1 meets one of the valid siren selection criteria of siren detector functions shown in 9, 10, 11, and 12, and (b) the sound reaching then input transducer 1 exceeds the detection threshold criteria of the sound level threshold detector 14. For very noisy environments, the PREEMPT detection logic 15 would only enable the PREEMPT output to the traffic light controller when; (a) the scared reaching then input transducer 1 meets one of the valid siren selection criteria of siren detector functions shown in 9, 10, 11, and 12, and (b) the sound reaching then input transducer 1 exceeds the detection threshold criteria of the sound level threshold detector 14, and (c) the signal to noise ration treasured at the output of the limiter-discriminator 6 measured by the squelch detector 13 exceeds a squelch detection threshold.

Figure 2A:
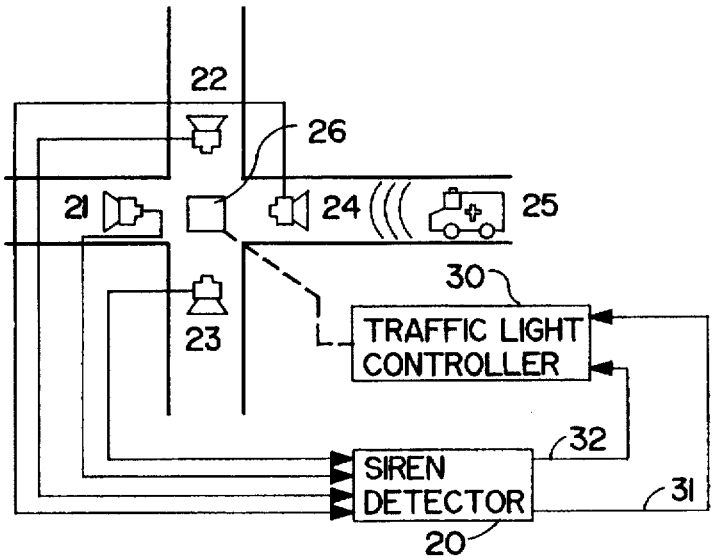
FIG. 2*a* and 2*b* are diagram illustrating the basic configuration of a four channel siren detector at a street intersection, and the configuration of a plurality of siren detectors.
Figure 2B:
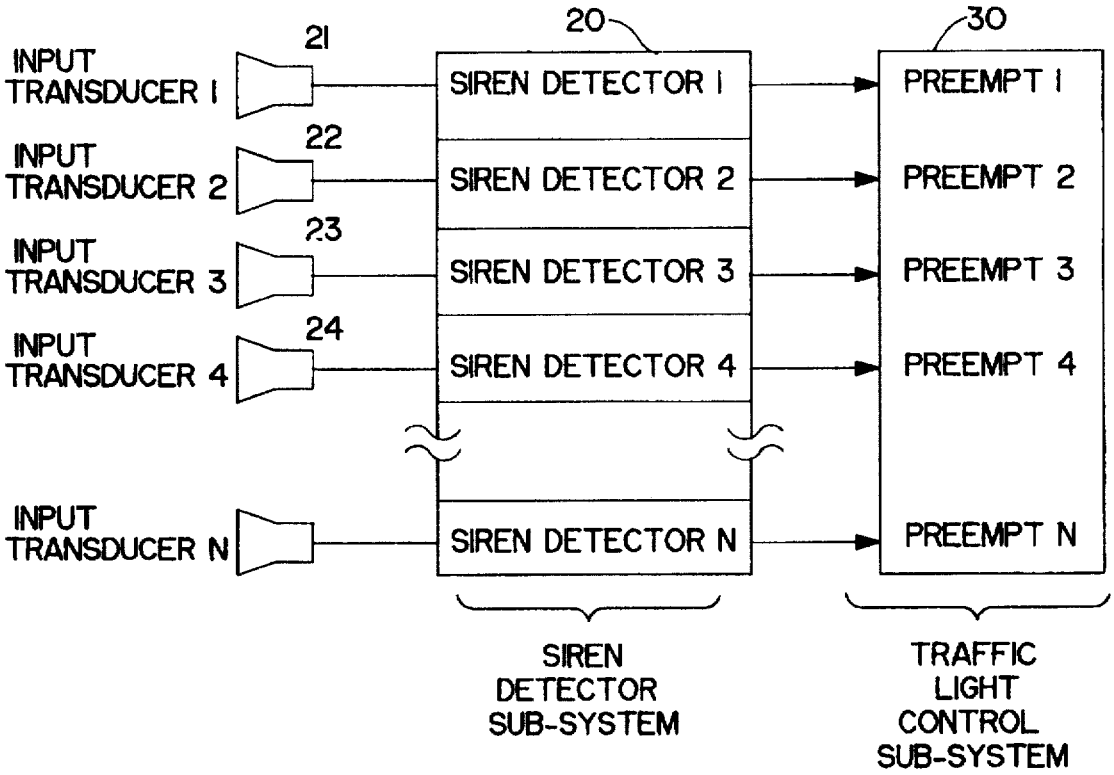

FIG. 2 (a) shows a typical installation with a traffic light 26, four input transducers 21, 22, 23, and 24 mounted such fit the) are optimized for detection of sound from from one of the four streets which approach the traffic signal 26. The output signals from these transducers go to a four channel siren detector 20 which processes the signals from the input transducers. If an emergency vehicle 25 approaches in the direction of input transducer 24, the channel in the siren detector processing that signal will indicate a PREEMPT signal to the traffic Light Controller 30 for that direction of the traffic light 26 using the traffic light preempt line 31, and/or the pedestrian control preempt line 32. The Traffic Light Controller could then be configured to give the emergency vehicle 25 priority access to the intersection. As indicated in FIG. 2(*b*), the siren detector can consist of a plurality of siren detector channels ranging from 1 to many. However, 4 channels is the most common. Single channel detectors could be to control lights at the driveway to fire halls, police compounds, pedestrian controlled lights. etc.

Figure 3:
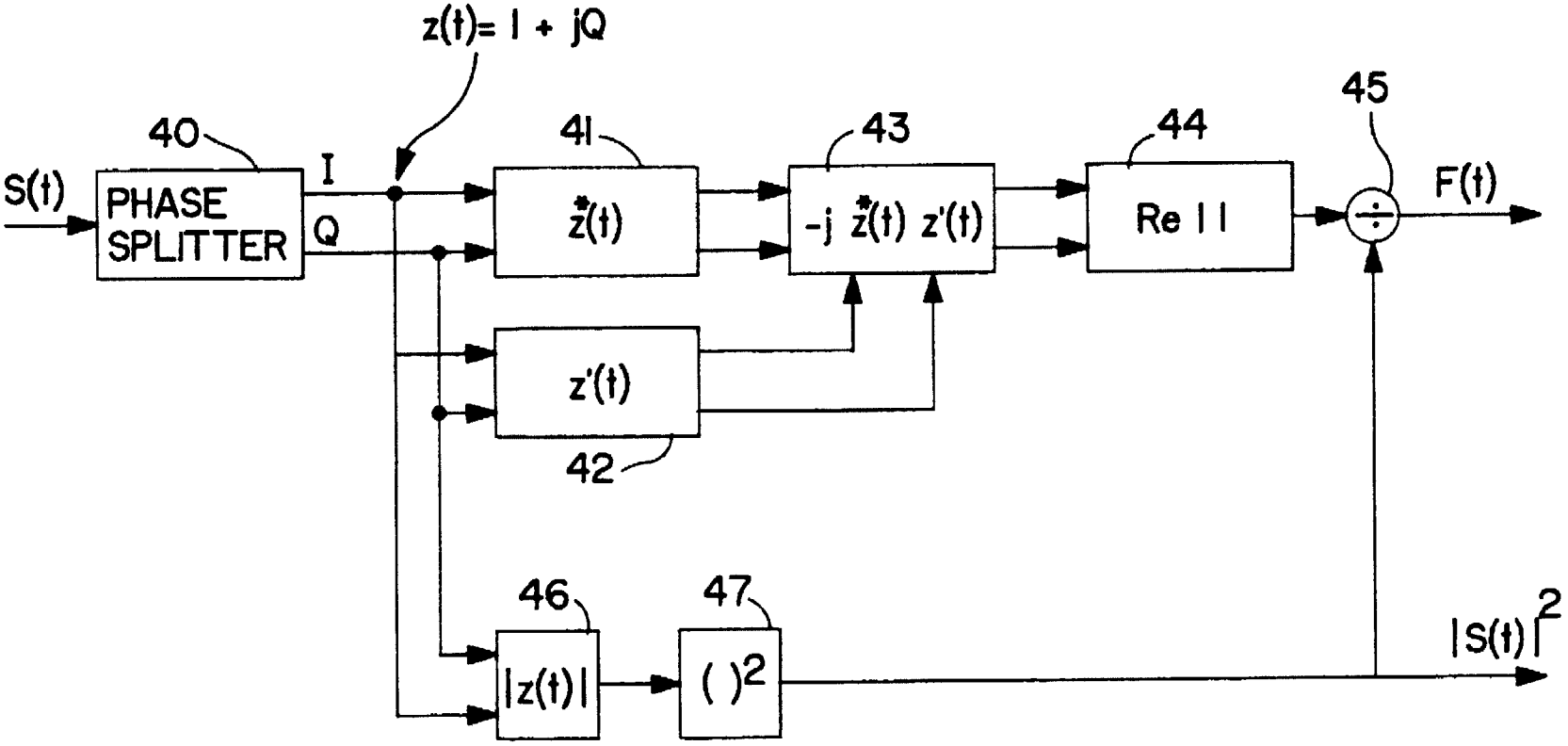
FIG. 3 is a block diagram illustrating the limiter discriminator of the siren detector according to the invention.

FIG. 3 shows one means for realizing a limiter-discriminator. The input signal is split into its real and imaginary components by the phase splitter 40. The complex conjugate and first derivative of the phase splitter output are formed by 41 and 42 respectively. The product of the complex conjugate and first derivative is taken, as well as multiplied by $-j=-\sqrt{-1}$. The real part of this product is taken by 44. The power of the input signal is determined by taking the magnitude of the phase splitter output in 46, and film squaring this signal in 47. The frequency of the input signal is then calculating by dividing in block 45 the output of 44 by the output of 47. The output of 47 also serves as the input to the sound level detector 14 in FIG. 1.

Figure 4A:
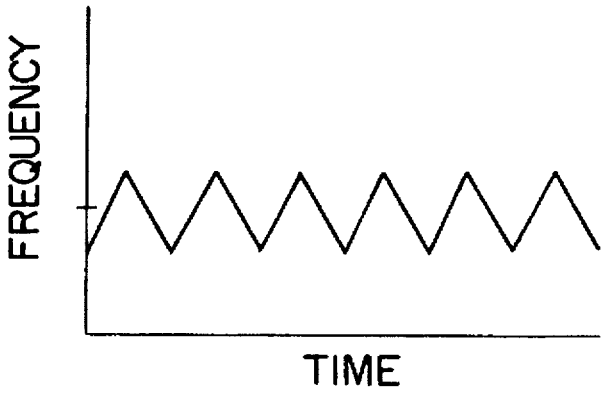
FIG. 4*a*, 4*b*, and 4*c* are diagrams illustrating the ideal characteristic signals of three of the many common types of siren sound which are detected when processed in accordance with the preferred embodiment of the invention.
Figure 4B:
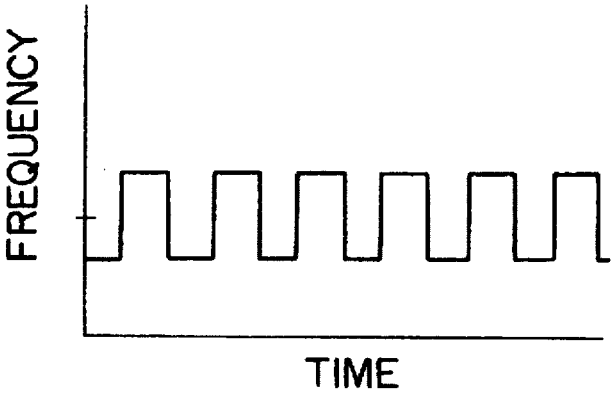
Figure 4C:
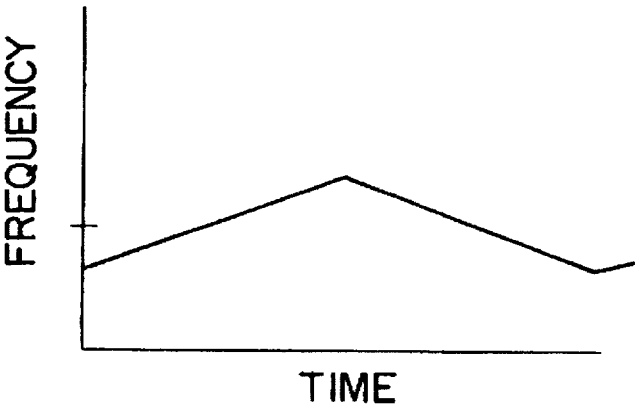

FIG. 4(*a*), (*b*), and (*c*) show the ideal frequency versus time characteristics of the three most common sirens, these being the yelp siren, high-low siren, and wall siren respectively. In actual practice, the sirens characteristics arc quite different. FIG. 5 shows the frequency versus time characteristic of a yelp siren. FIG. 6 shows the frequency versus time characteristic of a high-low siren. FIG. 7 shows the frequency versus time characteristic of a wall siren. In these three examples, the frequency was measured with actual sirens using the limiter-discriminator shown in FIG. 3.

Figure 9:
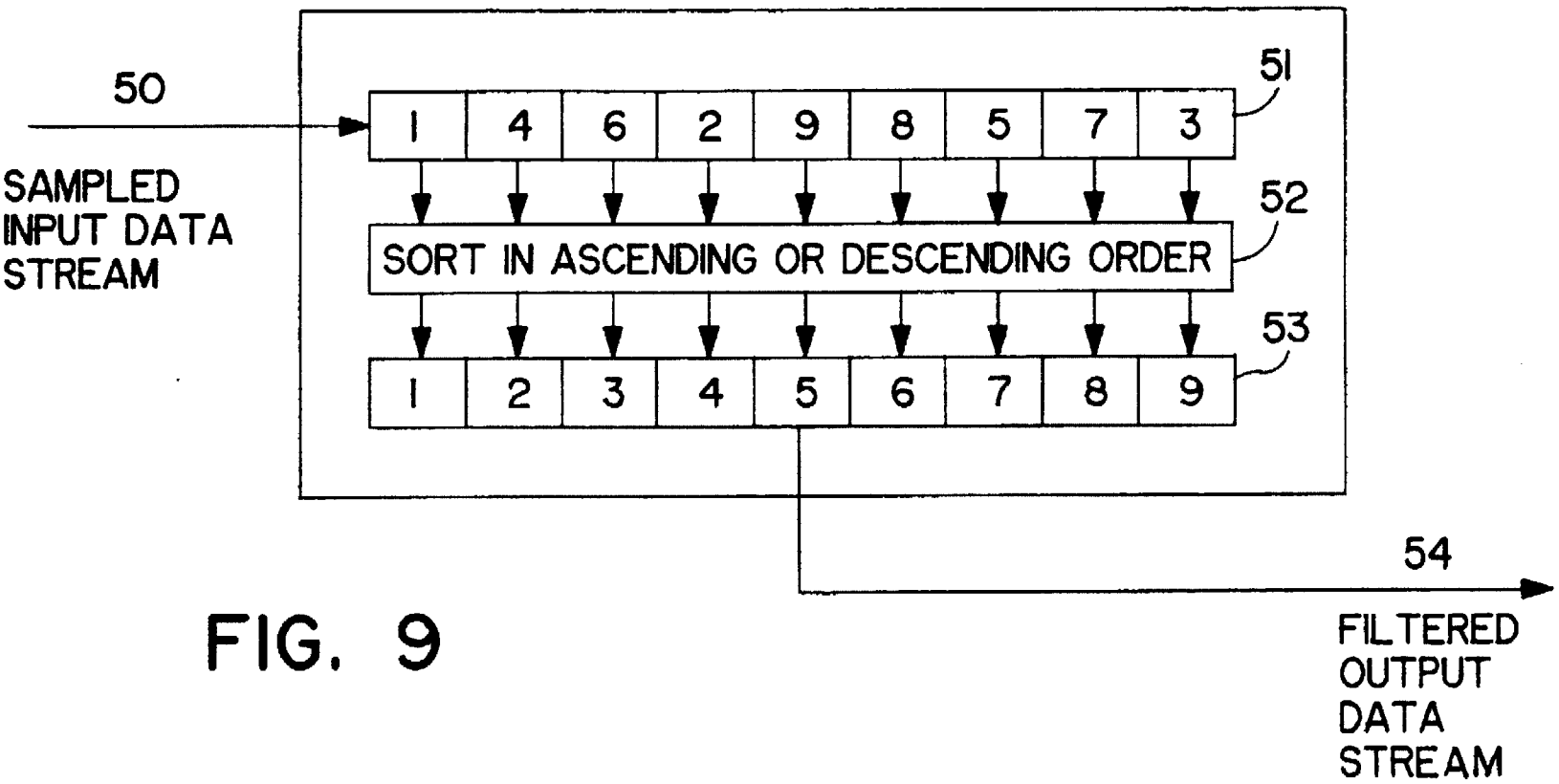
FIG. 9 is a diagram illustrating the operation of the median filter used as the click filter.

The Median filter is commonly used in image processing to remove impulsive noise. It operates by assembling an odd number of sequential data samples, sorting the samples in ascending or descending order, and then extracting the medial value. It operates in much the same way as sliding window finite impulse response filter, except that it is quite non-linear in nature. The use of the click filter is necessary for the detection of siren sounds where the signal to noise ratio is low. FIG. 8 shows the effect of the median falter on an actual wail siren signal having a low signal to noise ratio. The input signal is shown in FIG. 7. Using the example of the median filter shown in FIG. 9, the operation of the median filter can be easily demonstrated. The input samples 50 are serially shifted into the input shift register 51. They are sorted in ascending (or descending) order by the sorter 52 and reassembled in ascending (or descending) into the output register 53. From the output register 53, the medial value is taken and used as the output. In the example shown, the sampled data sequence in the register 51 is 1, 4, 6, 2, 9, 8, 5, 7, and 3. From this sequence the median filter selects 5 as the medial value. If a new input sample with a value 11 was input into the shift register 51, the end value 3 would be discarded and the input shift register 51 contents would become 11, 1, 4, 6, 2, 9, 8, 5, and 7. These would result in the output shift register contents becoming 1, 2, 4, 5, 6, 7, 8, 9, 11 after sorting. The medial value output by the filter 54 would be 6 in this case.

Figure 10:
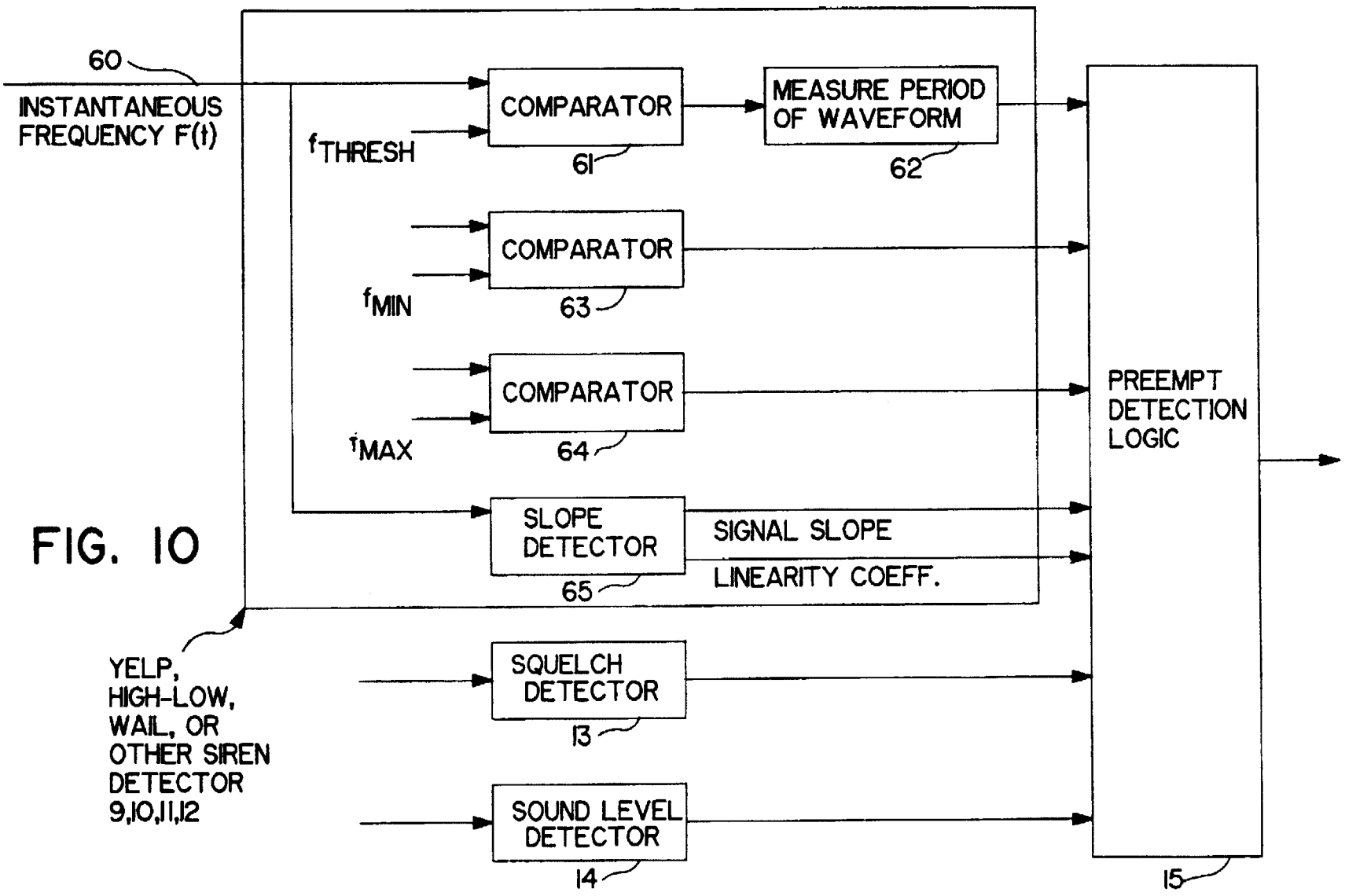
FIG. 10 is a detailed diagram of a generalized siren detector used for classifying a sound as being one of a number of desired siren types.

Three basic types of sirens detectors are used for the detection of most sirens. The main objective of these schemes is to provide a low probability of false detection, fairly fast detection and classification time of about 2 to 3 seconds maximum, and sufficient flexibility to accommodate variations in the siren characteristics. A common core siren detector is shown in FIG. 10, serving as the basis for the detection of yelp, wail, high-low, and other siren types.

Figure 12:
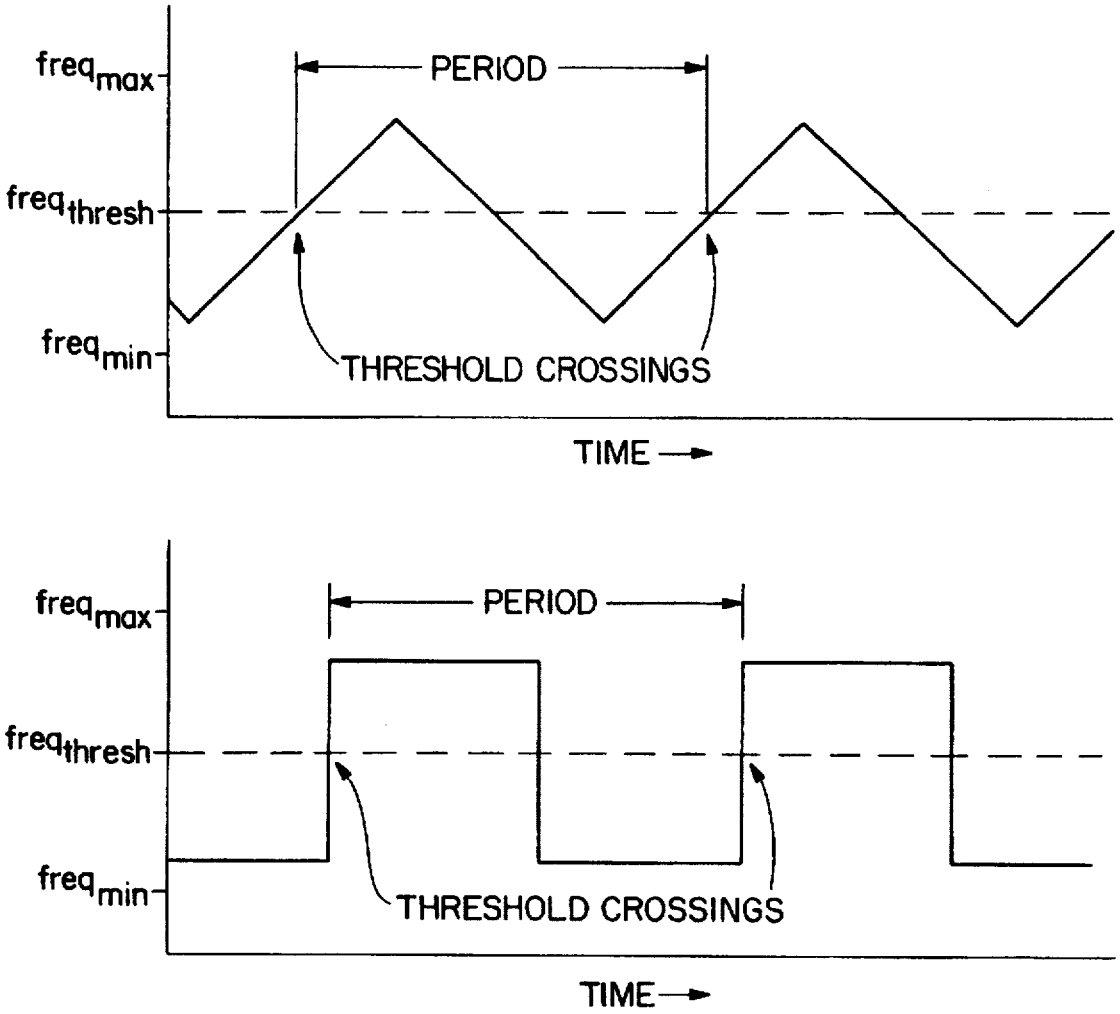
FIG. 12 is a diagram depicting the means for measurement of the waveform period for yelp and high-low sirens.

The first of these is the most general and is suitable for yelp siren, although other siren types could also be detected. It simply sets a frequency threshold comparator 61 with a frequency threshold $f_{thresh}$ midway between the minimum and maximum frequencies expected for a yelp siren, which is about 900 to 1000 Hertz. The period between times when the increasing frequency wave shape crosses the threshold for two successive threshold crossing is measured by 62. If this period falls within the user selected range for valid yelp sirens which is typically 0.27 seconds to 0.40 seconds, and the frequency of the siren signal is greater than a selectable minimum frequency $f_{min}$ and less than a selectable maximum frequency $f_{max}$, a counter is incremented. The frequency comparators 63 and 64 are used for the purpose of frequency comparison. If the next period is measured to be within the user selected region, the counter is incremented again. If the next period is measured to be outside of the user selected range, the counter is decremented. The counter minimum value is 0. If the counter level exceeds a user selected threshold, typically 3 or 4 for reliable detection, then the yelp detector output is enabled to indicate that a siren meeting the yelp detection has been detected. It should be apparent that the sense of the change in frequency from an increasing in time sense to a decreasing in time sense in relation to the frequency threshold crossings is also possible within the context of this invention. This means may, also be used for the high-low siren type, since this siren type is characterized by its periodic two frequency characteristic. The period measurement technique is shown in FIG. 12.

Figure 13:
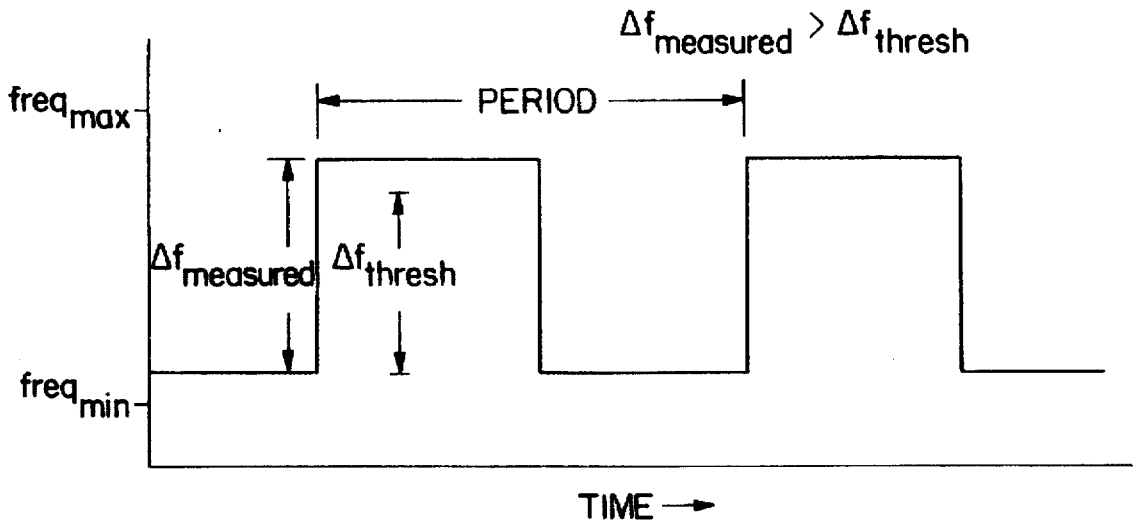
FIG. 13 is a diagram depicting an alternate means for measurement of the high-low siren.

The second of these is also suitable for high-low siren, although other siren types could also be detected. It simply sets a frequency difference threshold midway between the difference of the minimum and maximum frequencies expected for a high-low siren, which is about 100 to 150 Hertz. The frequency comparator 61 is then used to determine if the step in frequency between the low tone and the high tone exceeds some threshold $f_{thresh}$. The period between times when the increasing frequency wave shape crosses the threshold for two successive increasing frequency crossings is measured. If this period falls within the user selected range for valid yelp sirens which is typically 1.00 seconds to 1.3 seconds, and the frequency of the siren signal is greater than a selectable minimum frequency $f_{min}$ and less than a selectable maximum frequency $f_{max}$, a counter is incremented. The frequency comparators 63 and 64 are used for the purpose of frequency comparison. If the next period is measured to be within the user selected region, the counter is incremented again. If the next period is measured to be outside of the user selected range, the counter is decremented. The counter minimum value is 0 and typically has a maximum value of less than 20. If the counter level exceeds a user selected threshold, typically 3 or 4 to reliable detection, then the high-low detector output is enabled to indicate that a siren meeting the high-low detection has been detected. It should be apparent that the sense of the change in frequency from an increasing in time sense to a decreasing in time sense in relation to the frequency threshold crossings is also possible within the context of this invention. The period measurement technique is shown in FIG. 13. The third siren detector type is for the wail siren. This siren type is characterized by a very long period of between 4.8 and 7.2 seconds. It is readily apparent that if three to four complete cycles of a wail waveform were to be detected before the wail detect output were enabled, a detection time of about 15 or 20 seconds to 22 to 29 seconds would be required. This greatly exceeds the desired 2 to 3 seconds detection time. In fact, a siren equipped vehicle could easily be passed the intersection before the siren would have been detected. This highly undesirable situation is alleviated by observing the fact that the frequency characteristic is more or less a triangle wave with fairly straight portions to the curve. The Wail siren detector uses this fact, and uses a short duration sliding window of about 1.0 seconds in duration to perform a linear least squares fit to the sampled frequency dam. A linear equation of the form $$f=mt+b$$

is fit to a 1.0 second sequence of data samples, number 40 for the siren detector being discussed. In this equation, f is the frequency, t is the time, m is the slope of the line or rate of change of frequency, and b is the intercept frequency at t=0.0 seconds. Also calculated is the linear correlation coefficient of the fit between the straight line segment and the samples of data. One way of of calculating this linear correlation coefficient for N samples of data, with N being 40 in this case, is using the following equation:

$$r=\frac{N\Sigma t_i f_i-\Sigma t_i \Sigma f_i}{[N\Sigma t_i^2-(\Sigma t_i)^2]^{1/2}[N\Sigma f_i^2-(\Sigma f_i)^2]^{1/2}}$$

where $f_i$ is the frequency taken at time $t_i$ and N is the number of samples used in the linear fit. The value of r ranges from 0 where there is no correlation, to ±1 where there is complete correlation. The sign of r in this case is the same as that of the slope m, but it is only the magnitude r that is important and not the sign.

Figure 14:
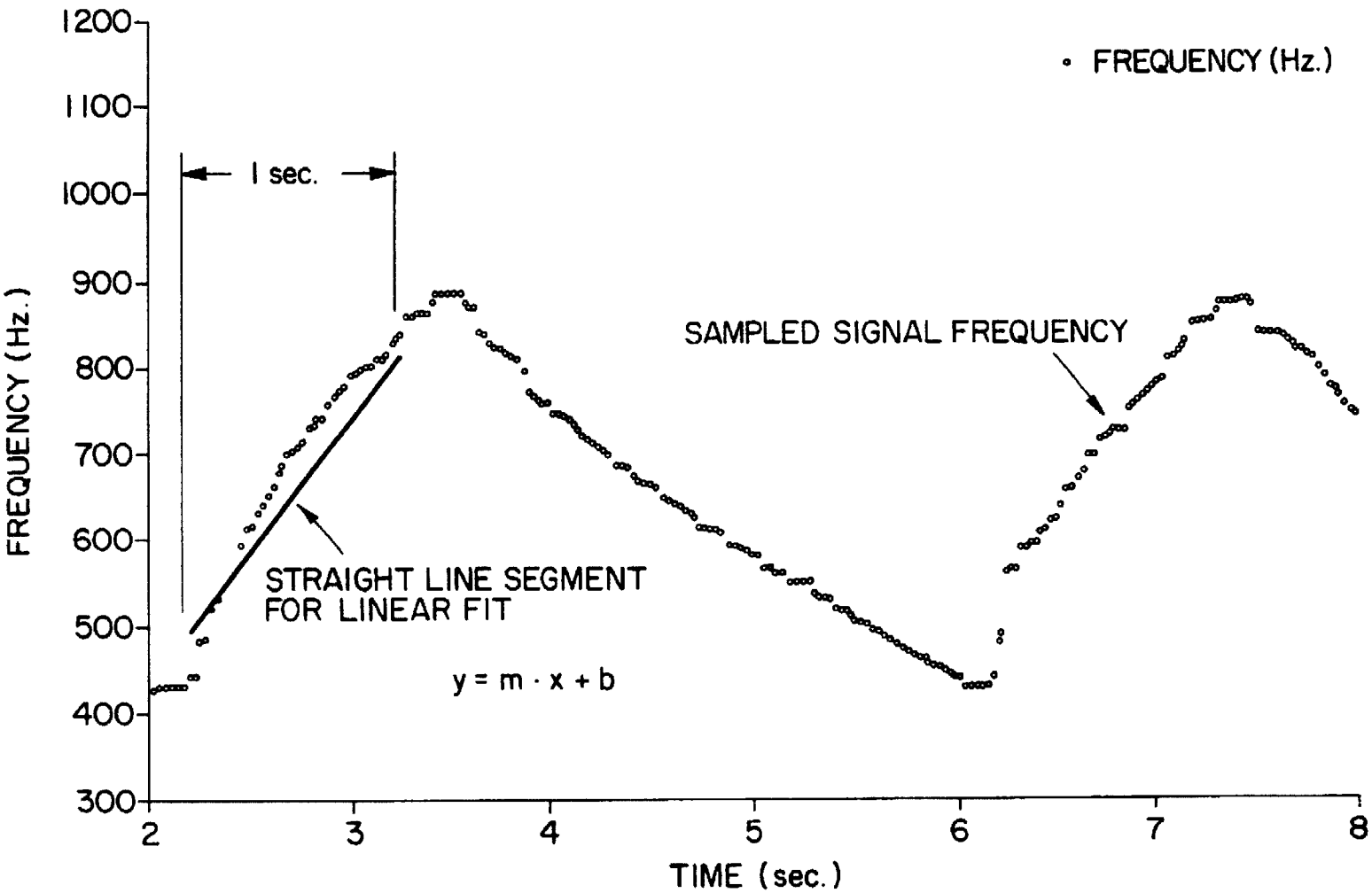
FIG. 14 is a diagram depicting the means by which a wail siren sound is detected using the linear least squares fit of a short line segment to the sampled siren data.
Figure 15:
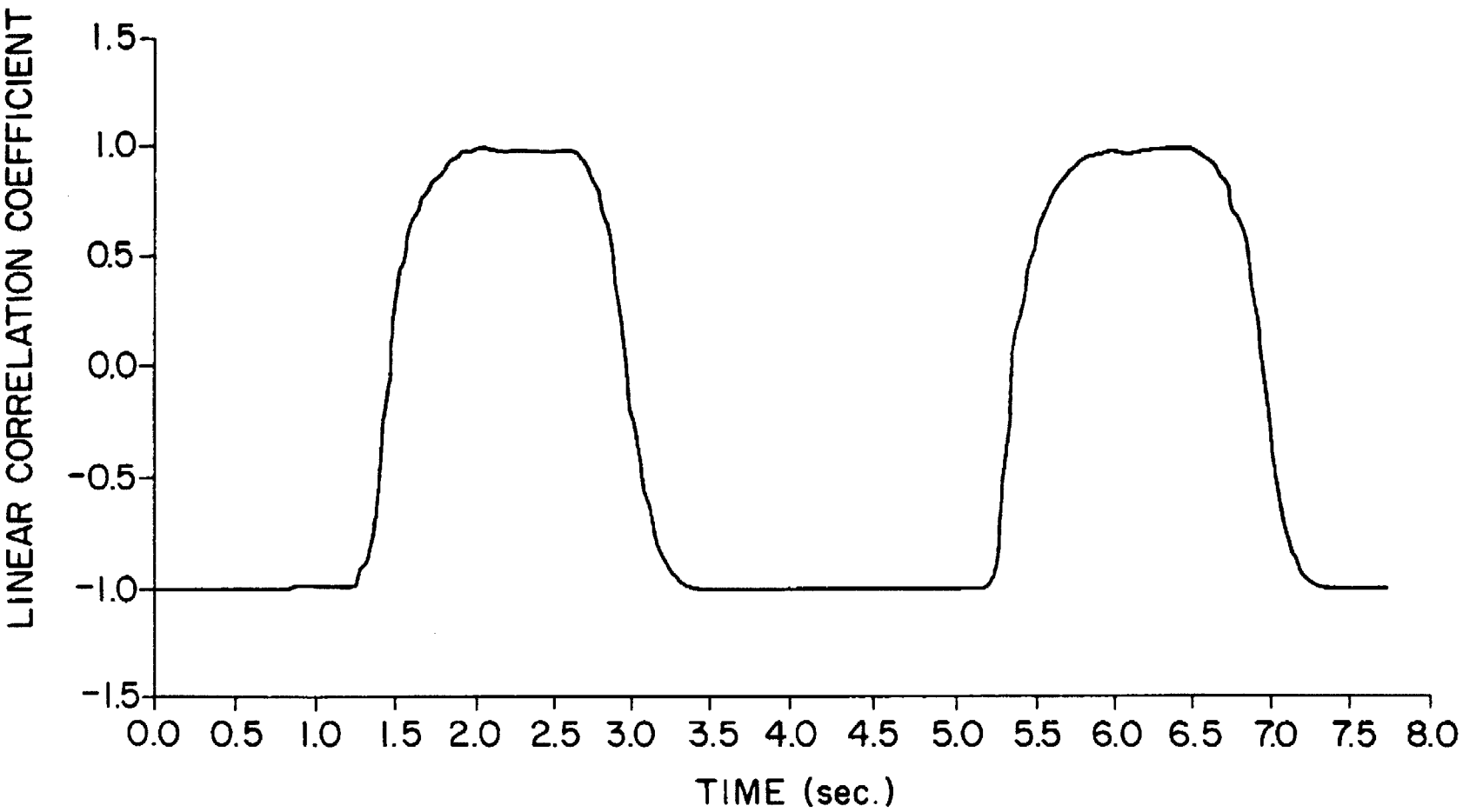
FIG. 15 is linear correlation coefficient plot for a linear least squares fit to a wail siren. This is the "linearity coefficient" output of the slope detector.
Figure 16:
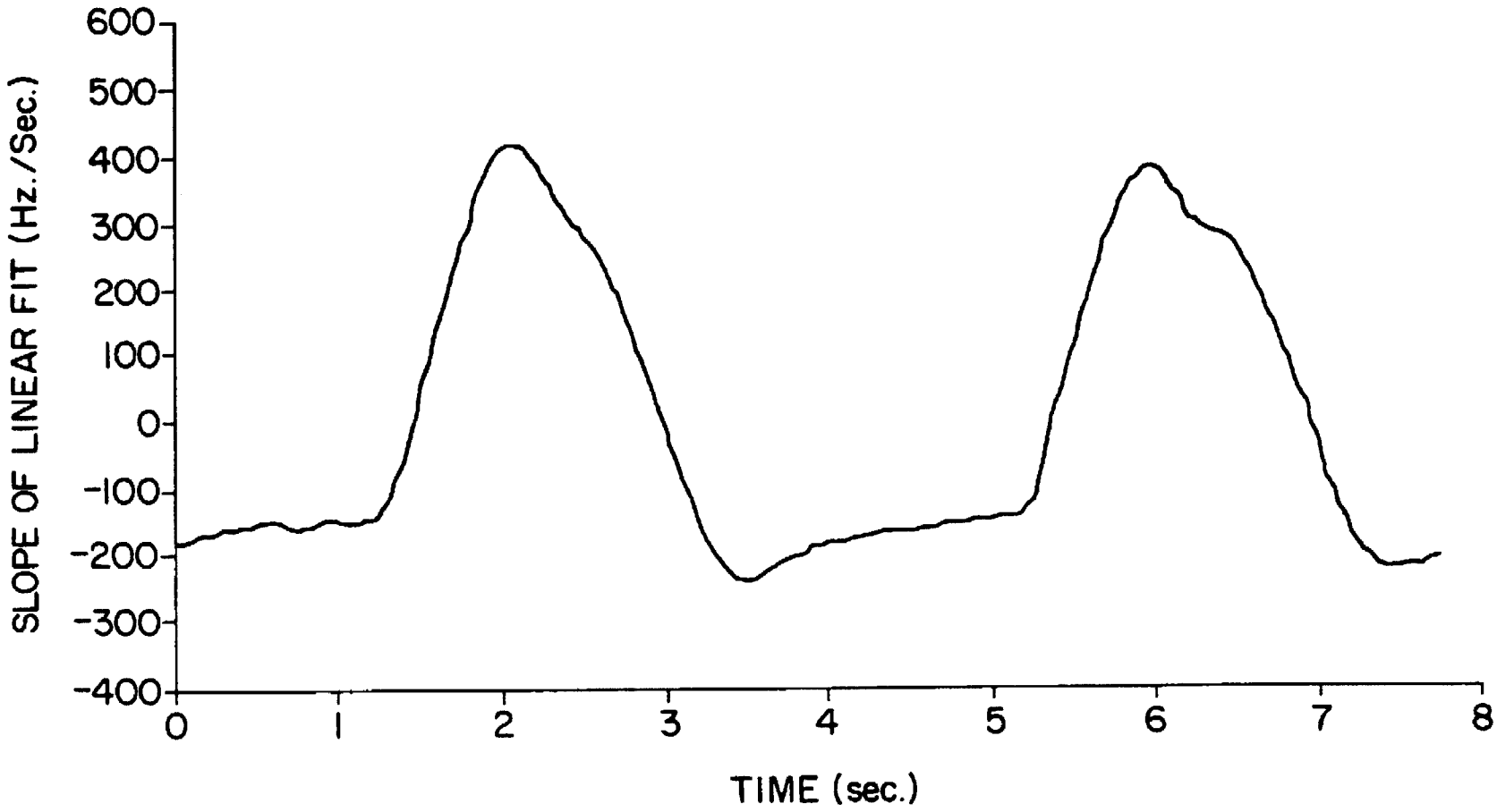
FIG. 16 is the signal slope output of the slope detector, which gives the rate of change of frequency of the siren signal, for a wail siren.

This linear least squares fit to the waveform and the frequency at any part of the waveform provide three classification criteria for the wail siren. These criteria are; (1) the frequency of the waveform must be with the user specified minimum and maximum frequencies as determined by comparators 63 and 64, (2) the rate of change of the frequency with time or slope of the straight line portion of the curves must fall within two user defined ranges, typically between ±300 Hz/sec to ±500 Hz/sec, as determined by the slope detector 65, and (3) the goodness of fit or correlation coefficient of the piecewise linear line segment to the frequency waveform as determinedby the slope detector 65, with the magnitude of a good linear elation coefficient typically being between 0.95 and 1.0. If the siren meets all three of these criteria, it can be reliably classified as a wail siren types. Typical detection times using this technique are the order of 2 to 3 seconds, making it as reliable as the yelp siren detection technique. The slope measurement technique is shown in FIG. 14. The slope m of the wail siren sound shown in FIG. 8 is shown in FIG. 15. and the linear correlation coefficient r is shown in FIG. 16. In this example, the sample rate was 40 Hertz and 40 sample points were used for the linear fit. This fit was performed at a rate of 40 Hertz.

Figure 11:
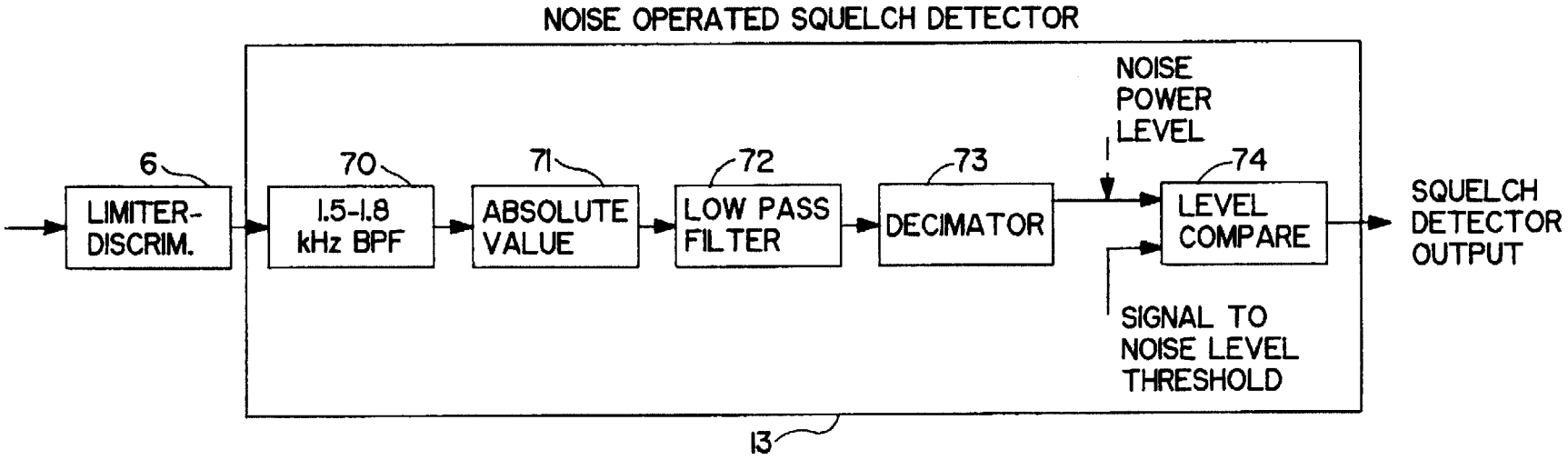
FIG. 11 is a block diagram of a noise operated squelch detector.

One common type of squelch detector is based on a noise operated squelch detector. This detector provides a signal which is a function of the baseband SNR of the liter-discriminator output. It is described in detail in Rhode and Ulrich. The operation of these noise detectors is based on the fact that as the carrier to noise ratio increases, the baseband noise energy density decreases. This detector used for this purpose is shown schematically in FIG. 11. The output of the 1.5 kHz to 1.8 kHz bandpass filter is "full-wave rectified" by the Absolute value block This output is then filtered by a simple low pass filter with a bandwidth of about 10 Hertz. The output of this filter is then decimated to a rate of 40 Hertz, reducing the subsequent processing rates. The decimated output, which is a function of the signal to noise ratio of the squelch input signals, is then compared against a user selected threshold and the threshold detector output enabled when the input signal is below the threshold level.

Figure 17:
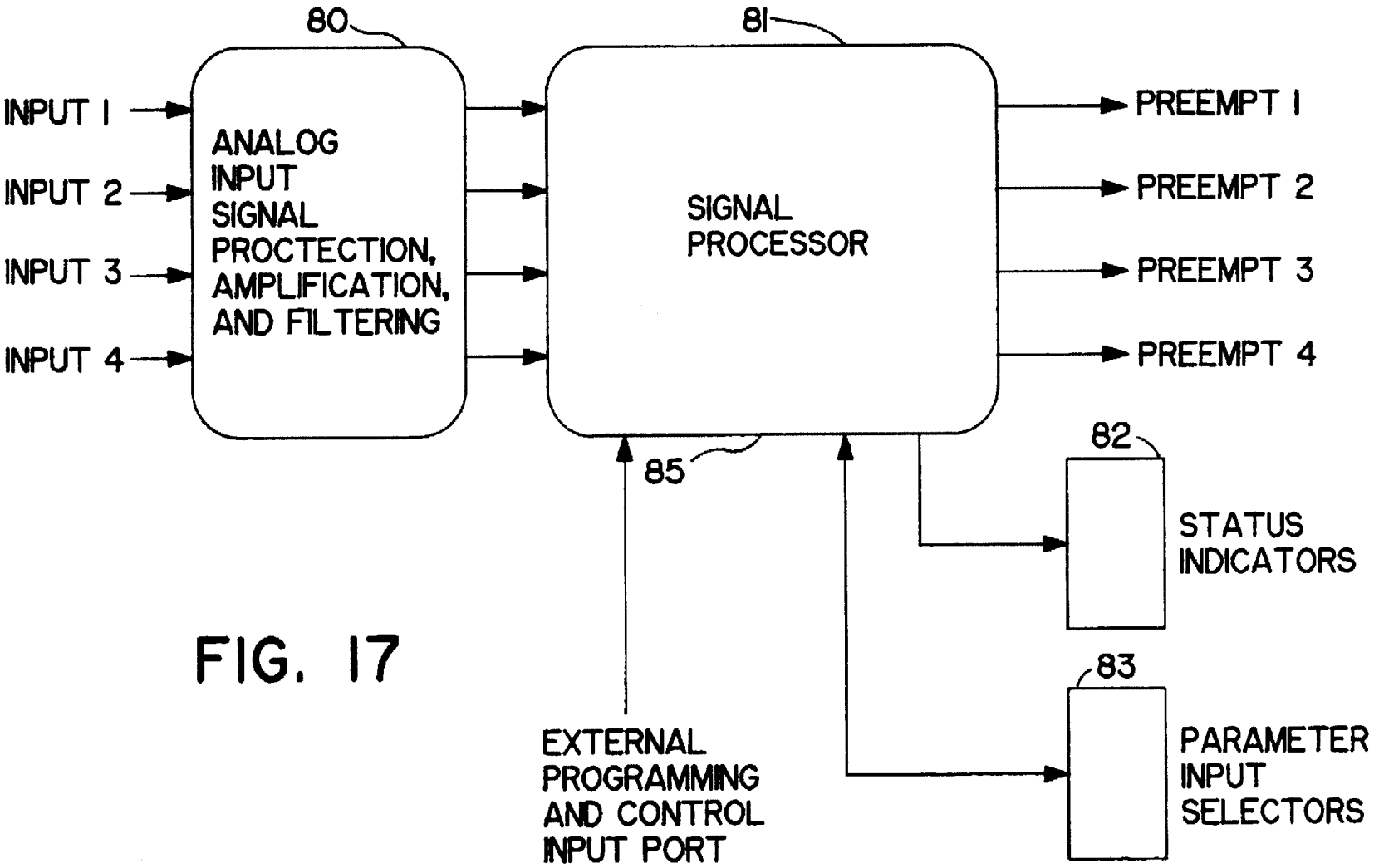
FIG. 17 is a block diagram of the siren detector showing the preferred embodiment.

Those skilled in the art will recognize that the siren detector described in this invention is ideally suited for implementation in a programmable computing device or digital signal processor. This has the many advantages over analog implementations, such as little if any effect of temperature on the performance, ease of adapting the siren detector to new siren sounds by reprogramming rather than modifications to the hardware, the ability to remotely reprogram the siren detector for new siren sounds, the ability to remotely control the siren detector, etc. This preferred implementation is shown in FIG. 17. The input signals from the input transducers are input to the Analog Input signal Protection, Amplification, and Filtering section 80 to provide electrical transient protection and signal conditioning. The signal processor 81 performs the analog to digital conversions and all of the processing functions described in this invention. Status indicators provide feedback to users as to the performance of the siren detector, detection of valid siren sounds, siren type, channel number activated, etc. Parameter input selectors 84 are provided to allow adjustment of the siren detection parameters locally. An External Programming and Control Input Port 85 is provided to allow local or remote reprogramming of the siren detector to update the software control program, or to locally or remotely change the siren detection parameters.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A siren detector for detecting siren sounds which precess at known rates within a selected frequency band to facilitate preemptable control of traffic light signals to enable an emergency vehicle to pass through a traffic intersection on a priority basis, said detector comprising transducer means for detecting said sounds and for producing an electrical sound output signal representative thereof, first filter means for filtering said sound output signal to produce an antialiased output signal to prevent aliasing in a subsequent analog to digital conversion process, and second filter means for producing a band-limited signal by filtering said antialiased output signal to reject signals outside said selected frequency band; and limiter-discriminator means for producing an indication of the frequency of said band-limited signal.

2. The siren detector as defined in claim 1, said detector further comprising a non-linear click filter responsive to said discriminator output signal for removing under low signal to noise conditions and for producing a filtered discriminator output signal.

3. The siren detector as defined in claim 1, said detector further comprising a sound level detection means responsive to said band-limited signal for producing a sound level signal indicating that a sound level within said selected frequency band at the input transducer means exceeds a selected sound intensity level.

4. The siren detector as defined in claim 1, said detector further comprising a squelch detection means responsive to said discriminator output signal for indicating that a signal to noise level within said selected frequency band at the input transducer means exceeds a selected signal to noise level.

5. The siren detector as defined in claim 1, said detector further comprising siren detection means responsive to said filtered discriminator output signal for measuring a period of the siren sound and for providing an indication that said period is within a selectable range.

6. A siren detector as defined in claim 2, said detector further comprising siren detection means to measure the period of the siren signal and provide an indication that said period is within a selectable range.

7. The siren detector as defined in claim 5, wherein said siren detection means further comprises means responsive to said filtered discriminator output signal for measuring a frequency of the siren sound and for providing an indication that the frequency of said siren sound is within a selectable range.

8. The siren detector as defined in claim 6, said detector further comprising siren detection means responsive to said filtered discriminator output signal for measuring a frequency of the siren sound and providing an indication that the frequency of said siren sound is within a selectable range.

9. The siren detector as defined in claim 1, said detector further comprising siren detection means responsive to said filtered discriminator output signal for measuring a rate of change of frequency of the siren sound and for providing an indication that said rate of change of frequency is within a selectable range.

10. The siren detector as defined in claim 2, said detector further comprising siren detection means responsive to said filtered discriminator output signal for measuring a rate of change of frequency of the siren sound and for providing an indication that said rate of change of frequency is within a selectable range.

11. The siren detector as defined in claim 1, said detector further comprising a means for determining a correlation coefficient providing a measure of correlation between the precession rate of the siren sound and a straight line and for producing an indication that the correlation coefficient exceeds a selectable value.

12. The siren detector as defined in claim 2, said detector further comprising a means for determining a correlation coefficient providing a measure of correlation between the precession rate of the siren sound and a straight line and for producing an indication that the correlation coefficient exceeds a selectable value.

13. The siren detector as defined in claim 3, said detector further comprising a squelch detection means responsive to said discriminator output signal for producing a squelch detector signal indicating that a signal to noise level within said selected frequency band at the input transducer means exceeds a selected signal to noise level.

14. The siren detector as defined in claim 13, further comprising preempt control means for producing a preempt output signal for activating said traffic controller in response to said squelch detector, sound level detector, and siren detector signals.

15. A siren detector as defined in claim 7, said detector further comprising a means for producing a preempt output signal to the traffic light controller when the siren sound increases in level above a selectable threshold and for deactivating the preempt output signal when the siren sound decreases in level below a selectable threshold.

16. A siren detector as defined in claim 8, said detector further comprising a means for producing a preempt output signal to the traffic light controller when the siren sound increases in level above a selectable threshold and for deactivating the preempt output signal when the siren sound decreases in level below a selectable threshold, and holding the preempt output signal in an enabled state for a selectable period of time.

17. The siren detector as defined in claim 1, in which the siren detector is implemented in a programmable signal processor operated according to a computer program, the programmable signal processor having a communications port allowing the computer program to be externally loaded from an external programming source.

18. The siren detector as defined in claim 17, wherein the external programming source is remotely located.

19. The siren detector as defined in claim 2, wherein said non-linear click filter is a median filter.

20. The siren detector as defined in claim 13, said detector further comprising siren detection means responsive to said filtered discriminator output signal for measuring a period of the siren sound and for producing a siren detector signal indicating that said period is within a selectable range.

21. The siren detector of claim 1 wherein said limited-discriminator means is further for mapping said band-limited signal onto the complex plane for computing a quantity proportional to the derivative of a phase portion of said band-limited signal, and for normalizing the resulting quantity to produce said indication of the frequency of said band-limited signal.

* * * * *